US008816935B2

(12) United States Patent
Liu et al.

(10) Patent No.: US 8,816,935 B2
(45) Date of Patent: Aug. 26, 2014

(54) DUAL FREQUENCY ANTENNA WITH WIDE FREQUENCY

(75) Inventors: Peng Liu, Guangdong (CN); Gee Siong Kok, Guangdong (CN)

(73) Assignee: Hytera Communications Corp., Ltd., Shenzhen, Guangdong (CN)

( * ) Notice: Subject to any disclaimer, the term of this patent is extended or adjusted under 35 U.S.C. 154(b) by 118 days.

(21) Appl. No.: 13/376,570

(22) PCT Filed: Jul. 31, 2009

(86) PCT No.: PCT/CN2009/073033

§ 371 (c)(1),
(2), (4) Date: Dec. 6, 2011

(87) PCT Pub. No.: WO2011/011928

PCT Pub. Date: Feb. 3, 2011

(65) Prior Publication Data

US 2012/0075165 A1 Mar. 29, 2012

(51) Int. Cl.
*H01Q 1/36* (2006.01)

(52) U.S. Cl.
USPC ..... 343/895

(58) Field of Classification Search
USPC ..... 343/895
See application file for complete search history.

(56) References Cited

U.S. PATENT DOCUMENTS

| | | | | |
|---|---|---|---|---|
| 3,852,759 | A * | 12/1974 | Felsenheld et al. | 343/729 |
| 4,772,895 | A | 9/1988 | Garay et al. | |
| 5,805,112 | A | 9/1998 | Cassel | |
| 6,452,555 | B1 | 9/2002 | Chang et al. | |
| 7,132,998 | B2 * | 11/2006 | Ryou et al. | 343/895 |
| 7,202,836 | B2 * | 4/2007 | Ooi et al. | 343/895 |
| 7,817,103 | B2 * | 10/2010 | Kersten et al. | 343/895 |

FOREIGN PATENT DOCUMENTS

| | | | |
|---|---|---|---|
| AU | 2284370 | A | 6/1972 |
| CN | 1102509 | A | 5/1995 |
| CN | 1275824 | A | 12/2000 |
| CN | 101431178 | A | 5/2009 |
| GB | 2 418 781 | A | 4/2006 |
| KR | 20080045876 | A | 5/2008 |
| KR | 20080094545 | A | 10/2008 |
| WO | WO 97/18601 | A | 5/1997 |

OTHER PUBLICATIONS

International Search Report dated May 6, 2010 from corresponding International Application No. PCT/CN2009/073033.
Extended European Search Report dated Jan. 30, 2013 from corresponding European Application No. 09847714.

* cited by examiner

*Primary Examiner* — Hoang V Nguyen
(74) *Attorney, Agent, or Firm* — Wolf, Greenfield & Sacks, P.C.

(57) ABSTRACT

A dual frequency antenna with wide frequency includes an inner radiator in helical structure, which is electrically connected with a host by a feeding point of the host, and an outer radiator in helical structure in which the inner radiator is packed. The inner radiator includes a first radiating unit located at the lower part for generating resonance and a second radiating unit located at the upper part. The resonant frequency of the second radiating unit is higher than that of the first radiating part; the height of the helical structure of the outer radiator is less than the total height of the inner radiator. The performance of dual frequency antenna can better focus on the upper hemisphere, and the bandwidth of the dual frequency antenna is wider in the ultra high frequency (UHF) frequency band.

8 Claims, 8 Drawing Sheets

DUAL FREQUENCY ANTENNA WITH WIDE FREQUENCY

FIELD OF THE INVENTION

The present invention relates to an antenna, in particular, to a wide band dual-frequency antenna.

BACKGROUND OF THE INVENTION

In present informational society, people usually wish to receive useful information conveniently whenever and wherever. Therefore, various portable wireless communication devices are widespread in people's daily lives. In a wireless device, an antenna which is used to transmit and receive radio waves so as to transfer radio signals is undoubtedly one of the very important elements. For a variety of handhold terminal devices, an antenna does not only need to be lightweight, thin and small in size, but also has to be preferably operated at a dual-frequency, and the frequency band has to be wider.

Currently, handhold terminal devices typically use a plurality of frequency bands to realize multiple functions or auxiliary functions, such as the frequency bands required by Global System for Mobile Communication (GSM) and Digital Cellular System (DCS) for a cell phone, an ultra-high frequency (UHF) for an interphone as well as the frequency for Global Positioning System (GPS), etc. Correspondingly, the antenna thereof is of a dual-frequency or a multiple-frequency. In the prior art, dual-frequency antennas mostly use a dual-frequency antenna having a dual array structure. FIG. 1 shows a schematic structural view of a dual-frequency antenna with a dual array structure in the prior art, wherein two portions on both sides of the feed point have a whip antenna structure and a planar helical structure respectively so as to form different resonant frequencies.

In the prior art, a dual-frequency antenna having a partial resonant structure is often used. In the partial resonant structure, a higher frequency band is typically designed in accordance with different structural parameters and the whole antenna array generates a kind of frequency, while high frequency resonance is generated by helices having different parameters, such as early cell phone antennas in which DCS frequency band is processed at the bottom of coil.

Currently, most external dual-frequency antennas are realized by a partial resonant structure. This is accomplished by a helical structure in which a high frequency resonant portion is placed at the bottom of coil and cooperates with another portion to form resonance at a lower frequency. However, in the prior art, for an external dual-frequency antenna of an interphone which operates at the working mode of UHF+GPS frequency band, a GPS resonant portion is placed at the bottom of helical so as to form resonance, as shown in FIG. 2. In this kind of design for a GPS frequency band, the performances of antenna are more concentrated on the lower half of sphere, while the performances on the upper half of sphere (the portion directing towards the sky) required by GPS are poor. Therefore, this design is not suitable for professional GPS performances and the function orientation of professional terminal devices. Moreover, in this kind of design for UHF frequency band, the bandwidth of antenna is not large enough. If a wide frequency UHF+GPS antenna (e.g., 380-430 MHz) having the same length is required, it is very hard to be achieved by this kind of design. The bandwidth in the UHF frequency band is relatively narrow under the influence of GPS frequency band. Therefore, there is a need for a dual-frequency antenna which not only has a good GPS directivity, but also has a wider bandwidth at ultra-high frequency.

SUMMARY OF THE INVENTION

The technical problem to be solved by the invention is to, in view of the defect that a dual-frequency antenna in the prior art cannot provide a good performance on an upper half of sphere required by GPS and possess a larger bandwidth at ultra-high frequency, provide a dual-frequency antenna in which the antenna performance at GPS frequency band can be better concentrated on an upper half of sphere and which has a larger bandwidth at ultra-high frequency.

The technical solution adopted by the invention in order to solve its technical problem is realized by configuring a wide band dual-frequency antenna which includes an inner radiator in helical structure, wherein the inner radiator is electrically connected to a host machine through a feed point of the host machine, and an outer radiator in helical structure, wherein the outer radiator covers the inner radiator, the inner radiator includes a first radiating portion located at a lower portion of the inner radiation and a second radiating portion located at a upper portion of the inner radiation to generate resonance, the resonant frequency of the second radiating portion is higher than the resonant frequency of the first radiating portion, and the height of the helical structure of the outer radiator is smaller than the total height of the inner radiator.

In the wide band dual-frequency antenna in accordance with the invention, the total height of the inner radiator is the length of one resonance of the antenna in operating frequency band.

In the wide band dual-frequency antenna in accordance with the invention, the pitch of the helical structure of the second radiating portion is larger than the pitch of the helical structure of the first radiating portion.

In the wide band dual-frequency antenna in accordance with the invention, the pitch of the helical structure of the second radiating portion is twice as large as the pitch of the helical structure of the first radiating portion.

In the wide band dual-frequency antenna in accordance with the invention, the height of the helical structure of the outer radiator is larger than the height of the first radiating portion.

In the wide band dual-frequency antenna in accordance with the invention, the outer radiator has two or more helical portions with different inner diameters.

In the wide band dual-frequency antenna in accordance with the invention, the smallest inner diameter of the helical portions of the outer radiator is larger than the biggest outer diameter of the inner radiator.

When implementing the wide band dual-frequency antenna of the invention, an additional radiator structure that can generate resonance is provided at the periphery of the inner radiator of dual-frequency coil to generate an additional resonant frequency close to local oscillation frequency of UHF of the inner radiator, so that the additional resonant frequency is added to or coupled with the local oscillation frequency of UHF so as to expand UHF frequency range. Thus, the antenna operates in two frequency bands, i.e. GPS band and UHF band. Meanwhile, by employing the first radiating portion and the second radiating portion having different pitches in the inner radiator, resonance portion of GPS can be located at the upper part of the helical structure, thus enabling antenna performance in GPS frequency band to be better concentrated on an upper half of sphere and simultaneously achieving a larger bandwidth in UHF frequency band.

BRIEF DESCRIPTION OF THE DRAWINGS

The invention will be further described with reference to appended drawings and embodiments hereinafter, wherein.

DETAILED DESCRIPTION OF THE INVENTION

By using an inner radiator and an outer radiator which covers the inner radiator, the wide band dual-frequency antenna in accordance with the invention which operates both in a GPS frequency band and a UHF frequency band can improve GPS performance so that GPS performances are more concentrated on an upper half of sphere and the bandwidth in UHF frequency band is larger.

Figure 1:
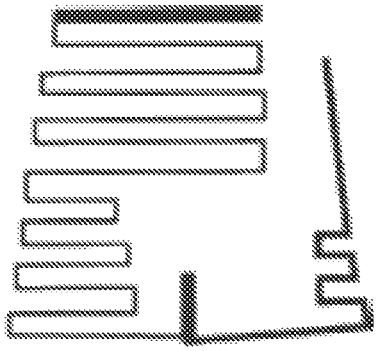
FIG. 1 is a schematic structural view of a dual-frequency antenna with a dual array structure in the prior art.
Figure 2:
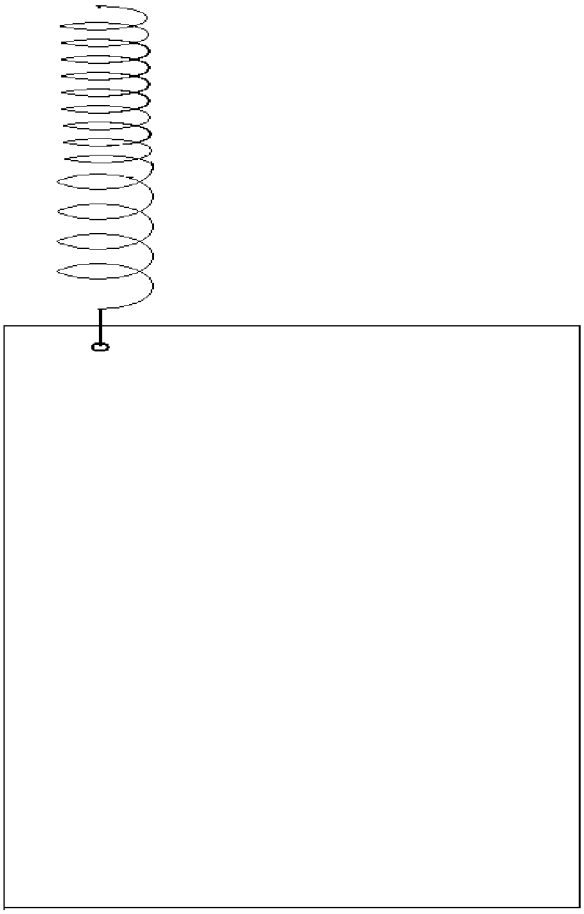
FIG. 2 is a schematic view of a partial resonant structure in the prior art, wherein a high frequency resonant portion is arranged at the bottom of a helical coil.
Figure 3:
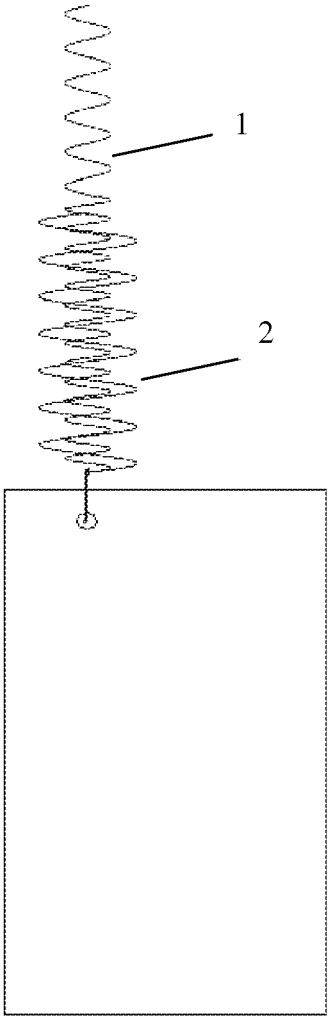
FIG. 3 is a schematic structural view of an embodiment of a wide band dual-frequency antenna in accordance with the invention.
Figure 4:
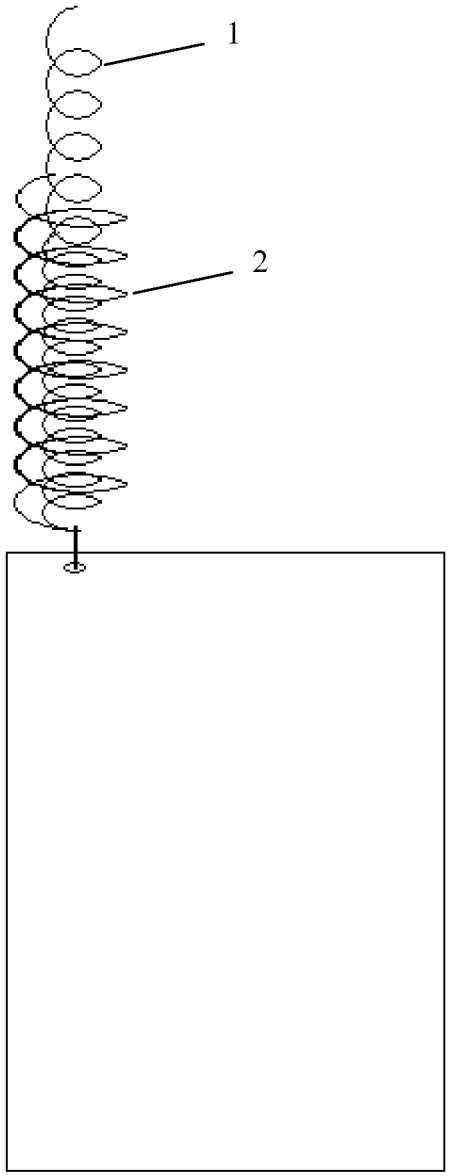
FIG. 4 is a schematic structural view of another embodiment of a wide band dual-frequency antenna in accordance with the invention.
Figure 5:
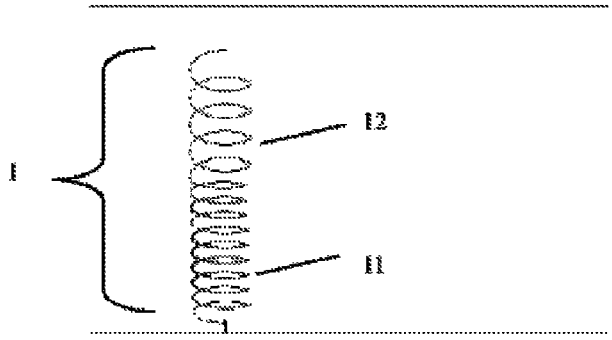
FIG. 5 is a schematic structural view of an inner radiator in an embodiment of a wide band dual-frequency antenna in accordance with the invention.

Reference is now made to FIGS. 3-5, wherein FIG. 3 is a schematic structural view of an embodiment of a wide band dual-frequency antenna in accordance with the invention, FIG. 4 is a schematic structural view of another embodiment of a wide band dual-frequency antenna in accordance with the invention, and FIG. 5 is a schematic structural view of an inner radiator in an embodiment of a wide band dual-frequency antenna in accordance with the invention. The wide band dual-frequency antenna according to the invention mainly uses two radiators with helical structures, i.e., an inner radiator 1 in helical structure and an outer radiator 2 in helical structure. The inner radiator 1 and the outer radiator 2 are electrically connected to a host machine through a feed point of the host machine. The inner radiator 1 consists of two different helical structures which locate at an upper portion and a lower portion of the inner radiator respectively, so as to generate resonance at different frequencies. The lower portion of the inner radiator 1 is provided as the first radiating portion 11 for generating resonance, and the upper portion of the inner radiator 1 is provided as a second radiating portion 12 for generating resonance at a frequency higher than that of the resonance generated by the first radiating portion 11. The height of helical structure of the outer radiator 2 is smaller than the total height of the inner radiator (the amount of the height of helical structure of the first radiating portion and the height of helical structure of the second radiating portion).

Figure 6:
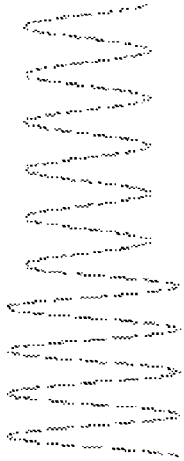
FIG. 6 is a schematic structural view of an outer radiator in an embodiment of a wide band dual-frequency antenna in accordance with the invention.
Figure 7:
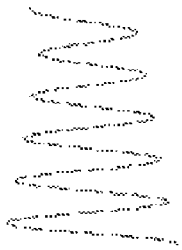
FIG. 7 is a schematic structural view of an outer radiator in another embodiment of a wide band dual-frequency antenna in accordance with the invention.

Preferably, the outer radiator has two or more helical portions having different inner diameters. FIGS. 6 and 7 show different structures of an outer radiator in different embodiments respectively. In FIG. 6, the outer radiator 2 consists of an upper helical portion having a smaller diameter and a lower helical portion having a bigger diameter. In FIG. 7, the diameter of the outer radiator 2 becomes large from top to bottom gradually. In this manner, the inner radiator 1 can be covered with the outer radiator 2. The inner radiator is covered with the outer radiator whose helical portion has a smallest inner diameter that is larger than the biggest outer diameter of the inner radiator so as to expand the bandwidth in GPS frequency band.

Moreover, the total height of the inner radiator 1 is the length of one resonance of the antenna in frequency range. The pitch of the helical structure of the second radiating portion is larger than that of the first radiating portion. Preferably, the pitch of the helical structure of the second radiating portion 12 is about twice as large as that of the helical structure of the first radiating portion 11. More preferably, the pitch of the helical structure of the second radiating portion 12 is twice as large as that of the helical structure of the first radiating portion 11 so that the helical structure of the second radiating portion is sparser than that of the first radiating portion so as to generate resonance at a higher frequency. The second radiating portion 12 together with the first radiating portion 11 can form resonance at a lower frequency. Meanwhile, since the pitch of the helical structure of the second radiating portion 12 is larger than that of the first radiating portion 11, the second radiating portion 12 can be used to generate resonance for GPS, while the first radiating portion 11 is mainly used to generate resonance at a lower frequency band.

In the dual-frequency antenna provided by the invention, the coils of the helical structures of the inner radiator and the outer radiator, after being stretched, have a length that is about one half of the its working resonance wavelength, and the resonant frequency of the outer radiator is close to that of the inner radiator (either a litter higher or a litter lower than the resonant frequency of the inner radiator). Since UHF of the antenna is in local oscillation mode, the influence on the bandwidth of UHF by antenna height is relatively strong. In the invention, an additional radiator structure that can generate resonance is provided at the periphery of the inner radiator of dual-frequency helical to generate an additional resonant frequency close to the local oscillation frequency of UHF, so that the additional resonant frequency is added to or coupled with the local oscillation frequency of UHF so as to expand UHF frequency band, without having an influence on performance of GPS.

The dual-frequency antenna according to the invention mainly operates at a radio frequency, an ultra-high frequency (UHF) at about 300-800 MHZ, and GPS frequency band. In the invention, the GPS resonant portion is placed at the top of the antenna so that GPS frequency band can form an omni-directional pattern and more performances of the antenna can be concentrated on an upper half of sphere so as to meet requirements on performances of professional GPS antenna.

Figure 8:
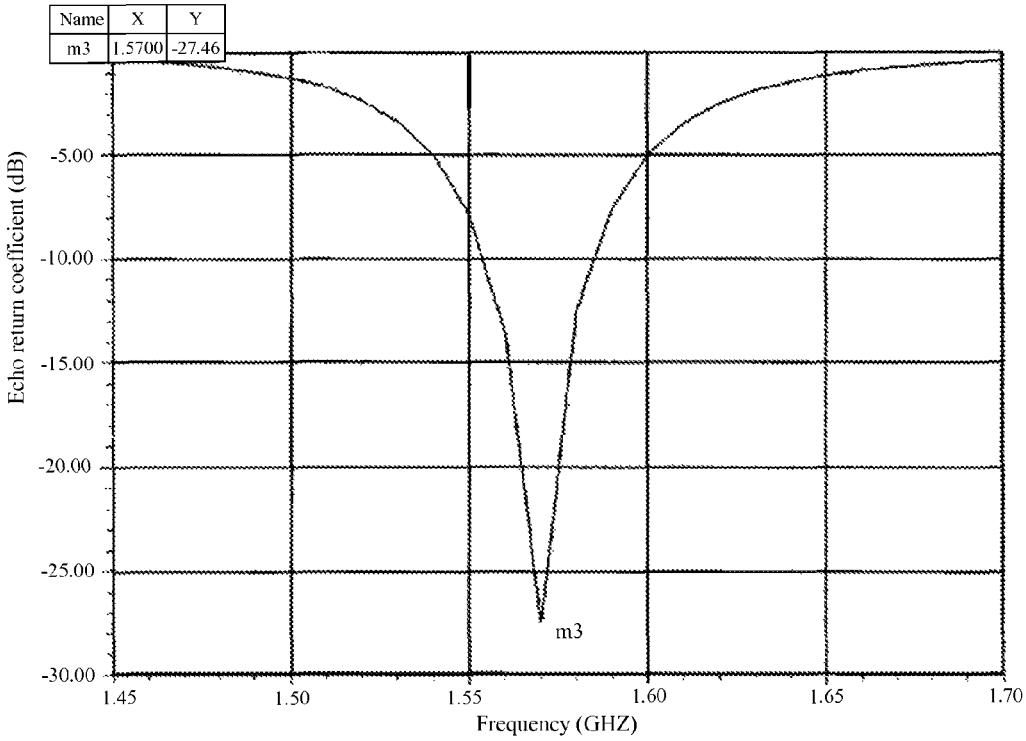
FIG. 8 is a schematic view showing echo return loss in GPS frequency band of a dual-frequency antenna only having an inner radiator structure in accordance with the invention.

Furthermore, the height of the helical structure of the outer radiator 2 is larger than of that of the first radiating portion of the inner radiator. Preferably, the height of the helical structure of the outer radiator 2 is larger than the height of the first radiating portion of the inner radiator, and smaller than or equal to the amount of the height of the first radiator and haft of the height of the second radiator. The operating bandwidth of antenna is mostly dependent upon the pitch of the helical structure of the outer radiator. FIG. 8 is a schematic view showing echo return loss in GPS frequency band of the dual-frequency antenna when only an inner radiator is included. As can be seen, echo return loss in many frequency bands of the antenna is large which means the antenna having a smaller bandwidth. However, the directivity of antenna is good.

Figure 9:
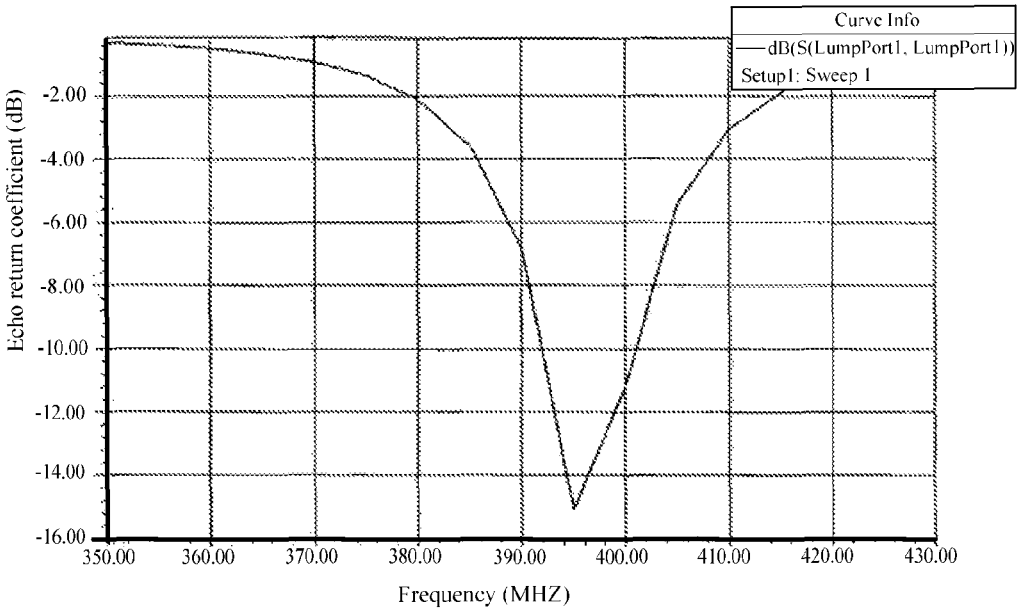
FIG. 9 is a schematic view showing echo return loss in UHF frequency band in an embodiment of a wide band dual-frequency antenna in accordance with the invention.
Figure 10:
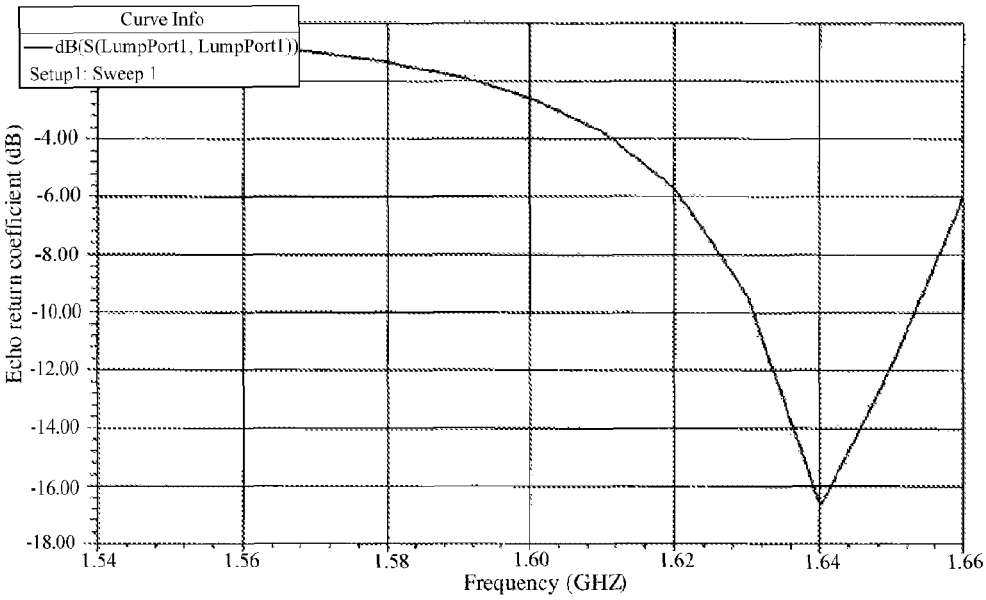
FIG. 10 is a schematic view showing echo return loss in GPS frequency band in an embodiment of a wide band dual-frequency antenna in accordance with the invention.
Figure 11:
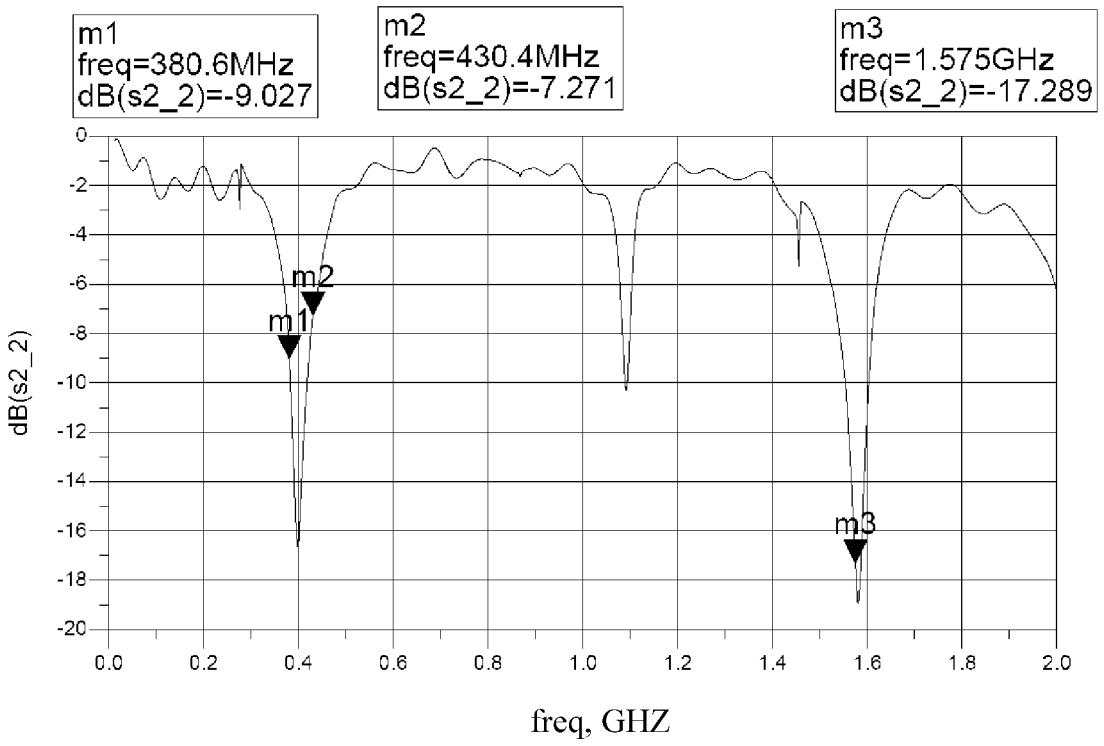
FIG. 11 is a view showing test results of frequency band parameters of antenna sample in an embodiment of a wide band dual-frequency antenna in accordance with the invention.
Figure 12:
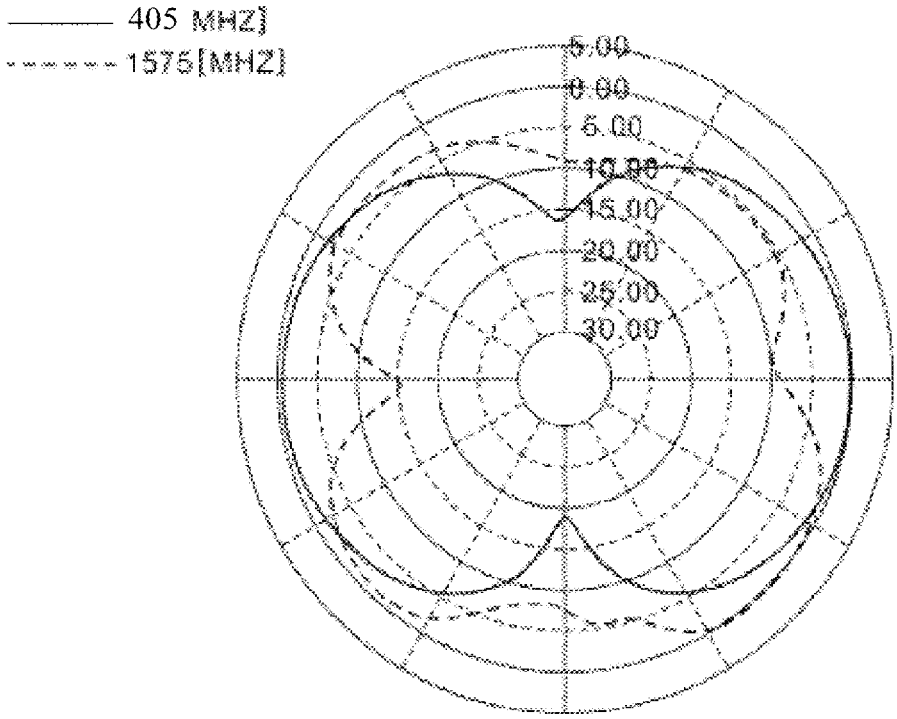
FIG. 12 is a 2-D view showing radiation performance in UHF frequency band in an embodiment of a wide band dual-frequency antenna in accordance with the invention.

Reference is now made to FIGS. 9-12, wherein FIG. 9 is a schematic view showing echo return loss in UHF frequency band in an embodiment of a wide band dual-frequency antenna in accordance with the invention, FIG. 10 is a performance simulation view of an antenna at GPS frequency band in accordance with the invention, FIG. 11 is a view showing testing results of frequency band parameters of antenna sample in an embodiment of a wide band dual-frequency antenna in accordance with the invention, and FIG. 12 is a 2-D view showing radiation performance in UHF frequency band in an embodiment of a wide band dual-frequency antenna in accordance with the invention. FIG. 9 reflects that the UHF performance of antenna is good. FIG. 10 shows the operating performance simulation view when the antenna is at a frequency of 1.54 GHZ-1.66 GHZ (i.e., in GPS frequency band). As can be seen, the antenna gain is high, being about 3.9 dBi. The antenna has a good performance in GPS frequency band, and half of the antenna performance is concentrated on an upper haft of sphere. The antenna simulation model shown in FIG. 10 is UHF (380-430)+GPS, the performance of which is normal in UHF frequency band and is not influenced by resonant portion of GPS. The antenna gain is about 1 dBi (the value of gain in this simulation is an ideal value when antenna case and host machine case are not added and PCB loss is not considered). FIG. 11 schematically shows the losses of the antenna in accordance with the invention at three different frequency points, i.e., three mark points m1, m2 and m3, wherein the bandwidth is about 50 MHZ (430-380). In FIG. 12, the dashed lines show radiation pattern of antenna when operating at 1575 MHZ, and the solid lines show radiation pattern of antenna when operating at 405 MHZ. As can be seen, the test result shows that the antenna efficiency in the whole frequency band also meets people's requirements. The radiation pattern of antenna does not have overly deep recess in the upper half plane and directional pattern parameters are approximately symmetrical.

While providing a better GPS directivity, the antenna according to the invention realizes a larger bandwidth in UHF frequency band. The bandwidth can be increased by about 2 times. For example, the frequency bandwidth achieved when the dual-frequency antenna provided by the invention has a height of 65 mm is the same as that when the exiting antenna had a length height of 95 mm. For example, when the height of the outer radiator is 30 mm and the height of the inner radiator is 46 mm, the outer radiator mainly operates at the frequency of 410-445 MHZ, and the inner radiator mainly operates at the frequency of 385-400 MHZ. After being coupled, the inner and outer radiators can make the whole antenna operate at the frequency of 380-430 MZH. For example, in this manner, a radio can search more channels.

To sum up, in the antenna provided by the invention, an additional UHF resonant portion, as a helical structure with a larger diameter, is placed outside of a helical structure with two pitches, and the two radiators with those helical structures are connected though the same feed point. When the height of the outer radiator is no larger than that of the inner radiator, the directional pattern in GPS frequency band is still the same as that of a single coil, and the antenna performances are still concentrated on the upper half of sphere. With the invention, antenna performances in GPS frequency band are more concentrated on the upper half of sphere. Therefore, the antenna of the invention is suitable for use as professional GPS antenna and can also be applied to a variety of terminal devices, such as professional interphones. Meanwhile, the bandwidth in UHF frequency band is expanded.

Only preferred embodiments of the invention are described above, which are not used to limit the invention. Any modification, equivalent substitute or improvement made within the spirit and principle of the invention should be included in the scope of protection of the invention.

The invention claimed is:

1. A wide band dual-frequency antenna, comprising an inner radiator in helical structure, wherein the inner radiator is electrically connected to a host machine through a feed point of the host machine; and an outer radiator in helical structure, wherein the outer radiator covers the inner radiator and is electrically connected to the host machine at the feed point of the host machine, and wherein the inner radiator comprises a first radiating portion located at a lower portion of the inner radiator to generate resonance and a second radiating portion located at a upper portion of the inner radiation, the resonant frequency of the second radiating portion is higher than the resonant frequency of the first radiating portion, and the height of the helical structure of the outer radiator is smaller than the total height of the inner radiator.

2. The wide band dual-frequency antenna according to claim 1, wherein the total height of the inner radiator is the length of one resonance of the antenna in UHF frequency band.

3. The wide band dual-frequency antenna according to claim 2, wherein the pitch of the helical structure of the second radiating portion is larger than the pitch of the helical structure of the first radiating portion.

4. The wide band dual-frequency antenna according to claim 1, wherein the pitch of the helical structure of the second radiating portion is larger than the pitch of the helical structure of the first radiating portion.

5. The wide band dual-frequency antenna according to claim 4, wherein the pitch of the helical structure of the second radiating portion is twice as large as the pitch of the helical structure of the first radiating portion.

6. The wide band dual-frequency antenna according to claim 1, wherein the height of the helical structure of the outer radiator is larger than the height of the first radiating portion.

7. The wide band dual-frequency antenna according to claim 1, wherein the outer radiator has two or more helical portions with different inner diameters.

8. The wide band dual-frequency antenna according to claim 7, wherein the smallest inner diameter of the helical portions of the outer radiator is larger than the biggest outer diameter of the inner radiator.

* * * * *